US005131641A

United States Patent [19]

Hidaka

[11] Patent Number: 5,131,641

[45] Date of Patent: Jul. 21, 1992

[54] FINISHER FOR AN IMAGE RECORDER

[75] Inventor: Makoto Hidaka, Yokohama, Japan

[73] Assignee: Ricoh Company, Ltd., Tokyo, Japan

[21] Appl. No.: 709,975

[22] Filed: Jun. 4, 1991

[30] Foreign Application Priority Data

Jun. 4, 1990 [JP] Japan ..... 2-145597

[51] Int. Cl.[5] ..... B65H 39/00

[52] U.S. Cl. ..... 270/53; 270/37

[58] Field of Search ..... 270/52, 53, 37

[56] References Cited

U.S. PATENT DOCUMENTS 4,988,030 1/1991 Muramatu ..... 270/53

5,029,831 7/1991 Green ..... 270/53

FOREIGN PATENT DOCUMENTS 72569 4/1986 Japan ..... 270/53

75360 5/1989 Japan ..... 270/53

9005641 5/1990 PCT Int'l Appl. ..... 270/53

*Primary Examiner*—Edward K. Look

*Assistant Examiner*—Therese M. Newholm

*Attorney, Agent, or Firm*—Oblon, Spivak, McClelland, Maier & Neustadt

[57] ABSTRACT

A finisher for use with an image recorder staples a predetermined number of sheets sequentially driven out from the recorder and sequentially stacks a plurality of such stapled sets of sheets on a tray. A staple position changing device controls a stapler moving device such that a stapler staples a set of sheets at a particular position which is shifted by at least more than the length of a staple from the position where the preceding set of sheets was stapled. The sets of sheets so stapled at different positions are sequentially stacked on a tray.

9 Claims, 8 Drawing Sheets

LEFTWARD
2ms
PHASE Ao
PHASE Bo
PHASE A1
PHASE B1
PHASE Ao (bit 0) 1 1 0 0 1
PHASE Bo (bit 1) 0 1 1 0 0
PHASE A1 (bit 2) 0 0 1 1 0
PHASE B1 (bit 3) 1 0 0 1 1
(9) (3) (6) (12) (9)

RIGHTWARD
PHASE Ao
PHASE Bo
PHASE A1
PHASE B1
PHASE Ao (bit 0) 0 0 1 1 0
PHASE Bo (bit 1) 0 1 1 0 0
PHASE A1 (bit 2) 1 1 0 0 1
PHASE B1 (bit 3) 1 0 0 1 1
(12) (6) (3) (9) (12)

FINISHER FOR AN IMAGE RECORDER

BACKGROUND OF THE INVENTION

The present invention relates to an image recorder of the type printing out an image on a recording medium in the form of a sheet and then driving it thereoutof. More particularly, the present invention is concerned with a finisher for stapling a set of sheets sequentially driven out from such an image recorder and stacking the resultant stapled sets on a tray.

A finisher of the type described is extensively used with image recorders such as copiers and printers. The finisher binds a plurality of sets of sheets one by one while sequentially stacking them on a tray. It is a common practice with such a finisher to staple, i.e., to drive staples into all the sets of sheets at the same position. This brings about a problem that as the stapled sets are sequentially stacked on a tray, only the portions thereof adjacent to the staples rise relative to the other portions. As a result, the number of stapled sets which can be stacked on the tray and, therefore, the efficiency is reduced. Moreover, it is likely that the staple driven into a set of sheets being driven out onto the tray catches the staple of a stapled set which has already been stacked on the tray, resulting in the incomplete discharge and disorderly stacking of stapled sets.

SUMMARY OF THE INVENTION

It is therefore an object of the present invention to provide a finisher for an image recorder which surely discharges a stapled set of sheets onto a tray and stacks it neatly on the tray.

It is another object of the present invention to provide a generally improved finisher for an image recorder.

A finisher for binding each predetermined number of sheets sequentially fed thereto by a stapler having staples and thereby producing a plurality of stapled sets of sheets of the present invention comprises a stapler moving device for moving the stapler in a lengthwise direction of the staples, and a staple position control device for controlling the stapler moving device such that the stapler moving device shifts the stapler by a predetermined amount with each of sets of sheets and thereby causes the stapler to staple a given set of sheets at a particular position different from a position where the preceding set of sheets was stapled.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 11:
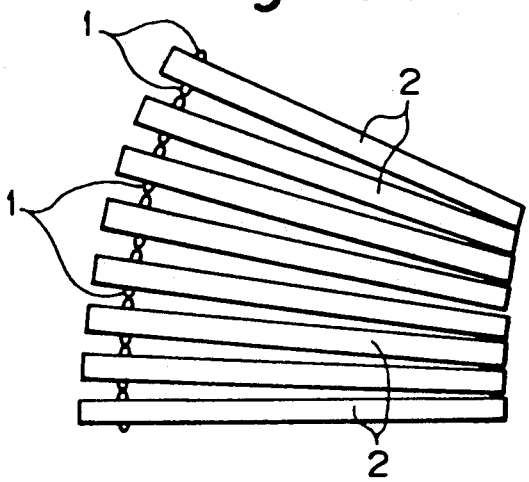
Fig. 11 PRIOR ART
FIG. 11 shows a specific condition wherein stapled sets of sheets are stacked on a tray by a conventional finisher.
Figure 12:
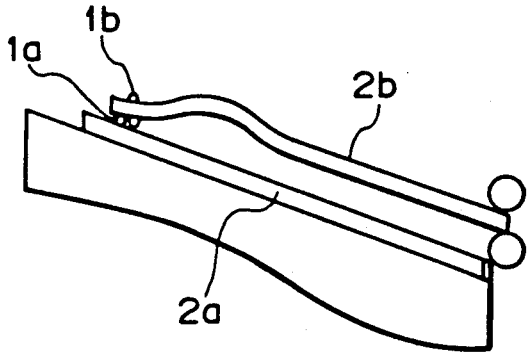
Fig. 12 PRIOR ART
FIG. 12 illustrates an undersirable condition particular to the conventional finisher.

To better understand the present invention, a brief reference will be made to a conventional finisher. FIG. 11 shows sets of sheets 2 sequentially stapled and then stacked on a tray, not shown, by the stapler of a conventional finisher. As shown, all the sets of sheets 2 are bound by staples 1 at the same position and stacked on the tray. In this condition, the portions of the sheet sets 2 around the staples 1 rise relative to the other portions where the staples 1 are absent, reducing the number of stapled sets which can be stacked on the tray. Moreover, as shown in FIG. 12, a staple 1*b* driven into a sheet set 2*b* being driven out onto a tray is apt to catch a staple 1*a* driven into a sheet set 2*a* which has already been stacked on the tray. Then, the sheet set 2*b* is prevented from being neatly positioned on the underlying sheet set 2*a*.

Figure 1:
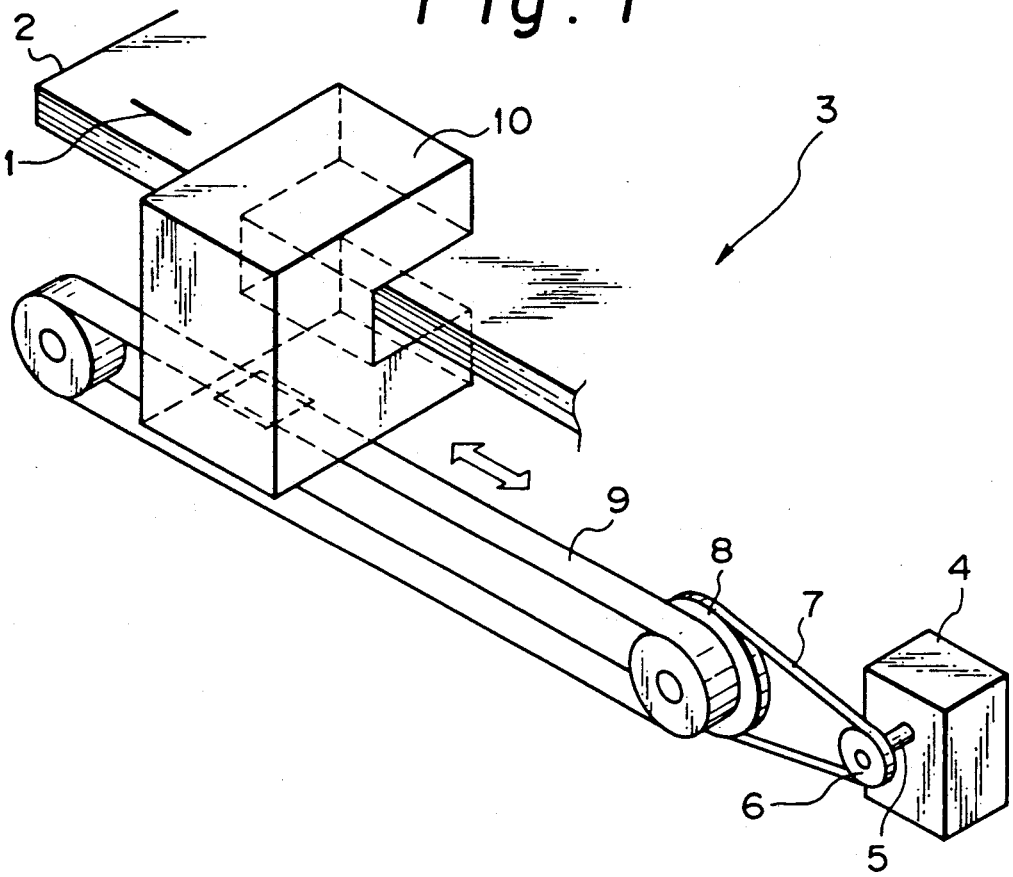
FIG. 1 is a perspective view of a stapler moving device for moving a stapler and included in a preferred embodiment of the finisher in accordance with the present invention.
Figure 2:
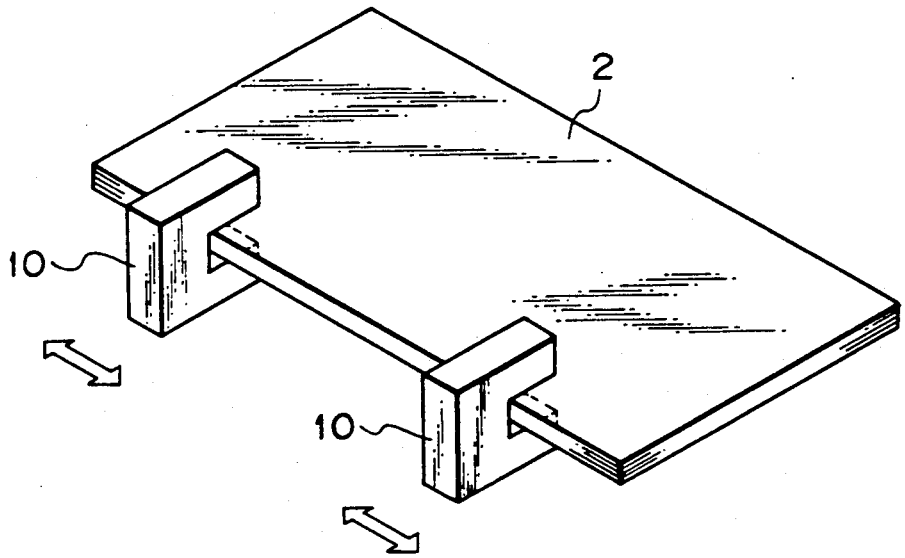
FIG. 2 is a perspective view indicating how the stapler shown in FIG. 1 is movable.

Referring to FIGS. 1 through 4, the general construction of a finisher embodying the present invention is shown. In these FIGURES, the structural parts or elements similar to those of the prior art finisher shown in FIGS. 11 and 12 are designated by the same reference numerals. FIG. 1 shows a device 3 for moving a stapler 10. The stapler moving mechanism 3 includes a stepping motor 4 having an output shaft 5. A pulley 6 is mounted on the output shaft 5 of the motor 4. A timing belt 7 is passed over the pulley 6 and another pulley 8 to reduce the rotation speed. The pulley 8 drives another timing belt 9 which is passed thereove. The stapler 10 is affixed to the timing belt 9 and, therefore, rotated by the stepping motor 4 in a direction indicated by an arrow in the FIGURE. More specifically, the stapler 10 is movable in the lengthwise direction of a staple 1 which binds a set of sheets 2. As shown in FIG. 2, a pair of staplers 10 may be used to staple the set of sheets 2 at two positions at the same time. In such a case, the two staplers 10 each may be driven by an independent stepping motor 4.

Figure 3:
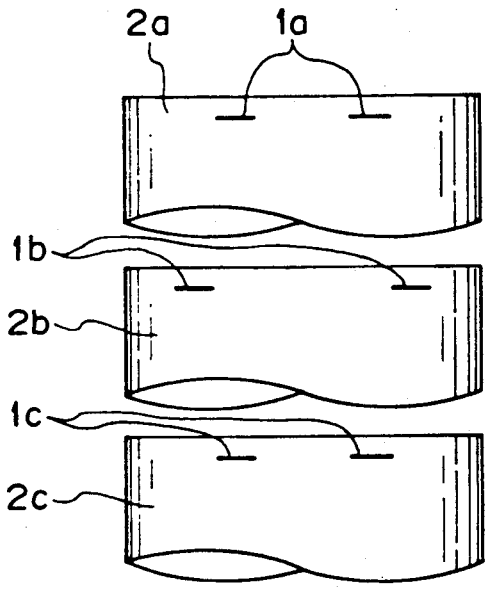
FIG. 3 shows positions where the stapler drives staples into successive sets of sheets.
Figure 4:
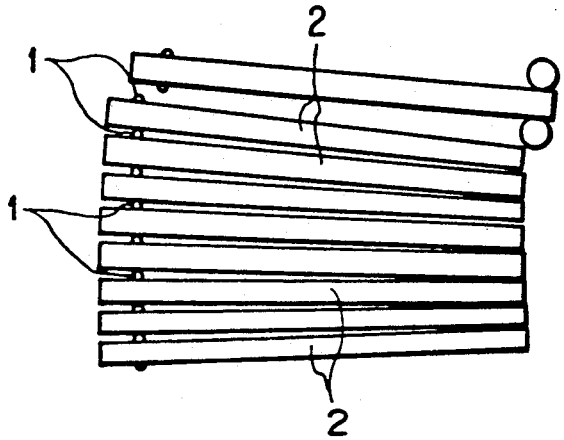
FIG. 4 shows a condition wherein stapled sets of sheets are stacked on a tray in accordance with the embodiment.
Figure 6:
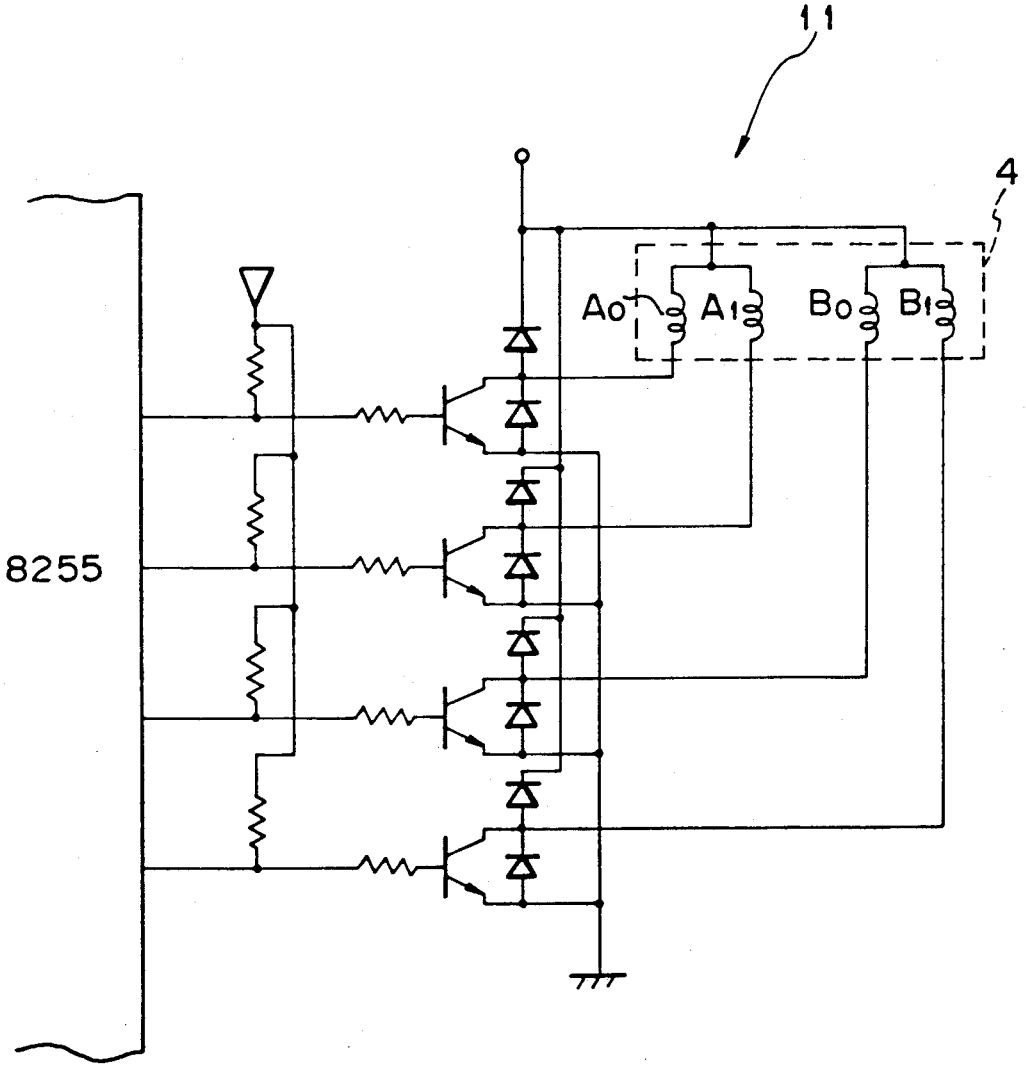
FIG. 6 is a digram showing a circuit for controlling a stepping motor included in the stapler moving device depicted in FIG. 1.
Figure 7A:
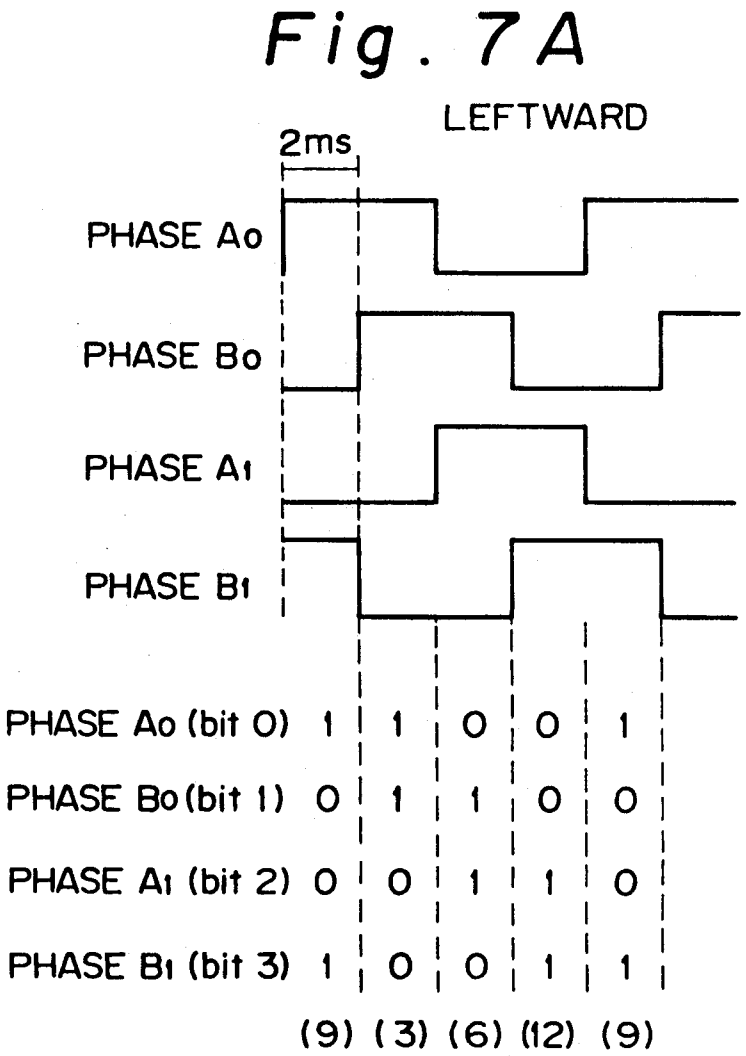
FIGS. 7A and 7B plot waveforms representative of specific patterns in which the stepping motor is energized.
Figure 7B:
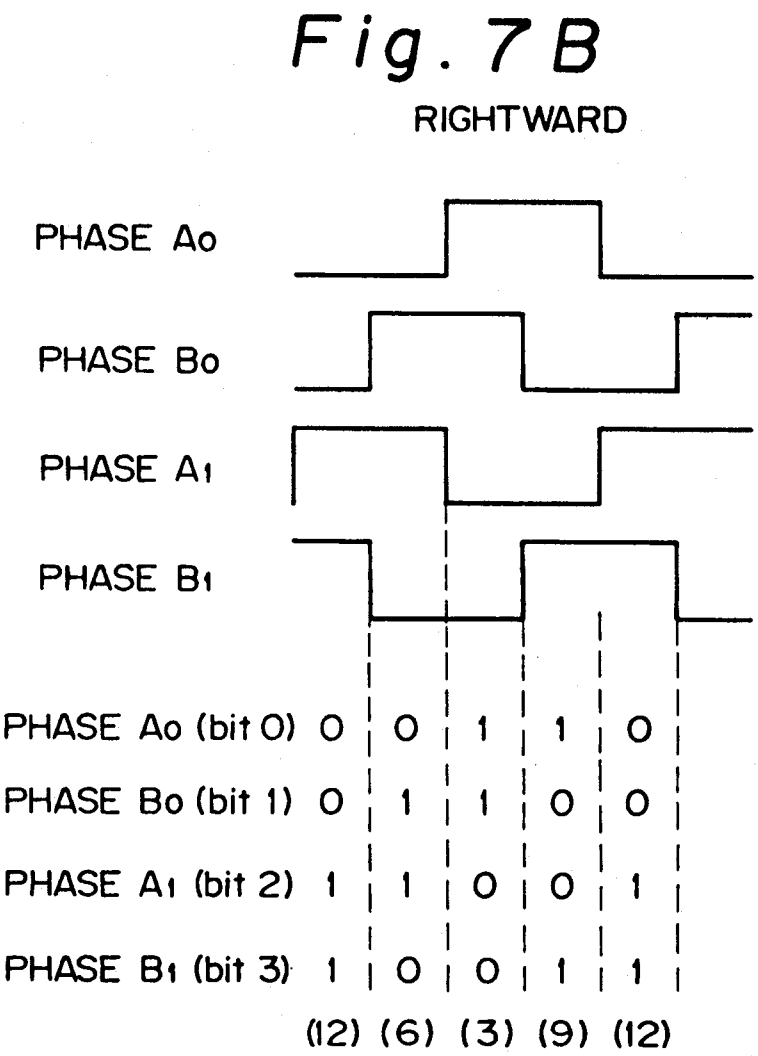

A device 11 (see FIG. 6) causes the stapler 10 to move a particular distance with each of the sheet sets 2, so that the sheet sets 2 each may be stapled at a particular position thereof. FIG. 3 depicts a specific condition in which each sheet set 2 is stapled at particular two positions due to the operation of the staple position changing device 11. As shown, a first sheet set 2*a* and a second sheet set 2*b* are stapled at different positions from each other, and so are the second sheet set 2*b* and a third sheet set 2*c*. As a result, as shown in FIG. 4, a greater number of sheet sets can be stacked on a tray, compared to the conventional condition shown in FIG. 11. FIG. 6 is a circuit diagram showing the stepping motor 4 and a circuit for controlling it. Specific patterns in which the stepping motor 4 are energized are shown in FIGS. 7A and 7B and will be described in detail later.

A transporting device, not shown, has roller for transporting the sheet sets 2 having been stapled at different positions thereof by the staple position changing device 11 to the tray. The transporting device is substantially the same as the prior art transporting device shown in FIG. 12, i.e., a conventional driving roller in combination with an idler roller. Further, a volume setting device, not shown, sequentially lowers the tray as the number of sheet sets 2 driven out by the transporting device increases, thereby maintaining the top of the stack on the tray at a predetermined level at all times. In such a construction, the sheet sets 2 different in stapled position from each other are sequentially stacked on the tray by the transporting device. As soon as the stack on the tray rises to a predetermined height, the volume setting device prevents succeeding sheet sets from being stacked on the tray and causes them to be stacked on the next tray. Such an arrangement is substantially similar to the conventional tray lowering and alignment mechanism shown in prior art FIG. 12.

As stated above with reference to FIG. 4, each sheet set 2 is stapled at a particular position or positions different from the others and then stacked on a tray. This eliminates the occurrence of FIG. 11 particular to the conventional finisher, i.e., prevents the number of sheet sets 2 which can be stacked on a tray from being reduced. Further, the staples driven into successive sheet sets 2 at different positions are prevented from interfering with each other (see FIG. 12), so that the sheet sets 2 are neatly stacked on a tray.

Figure 5:
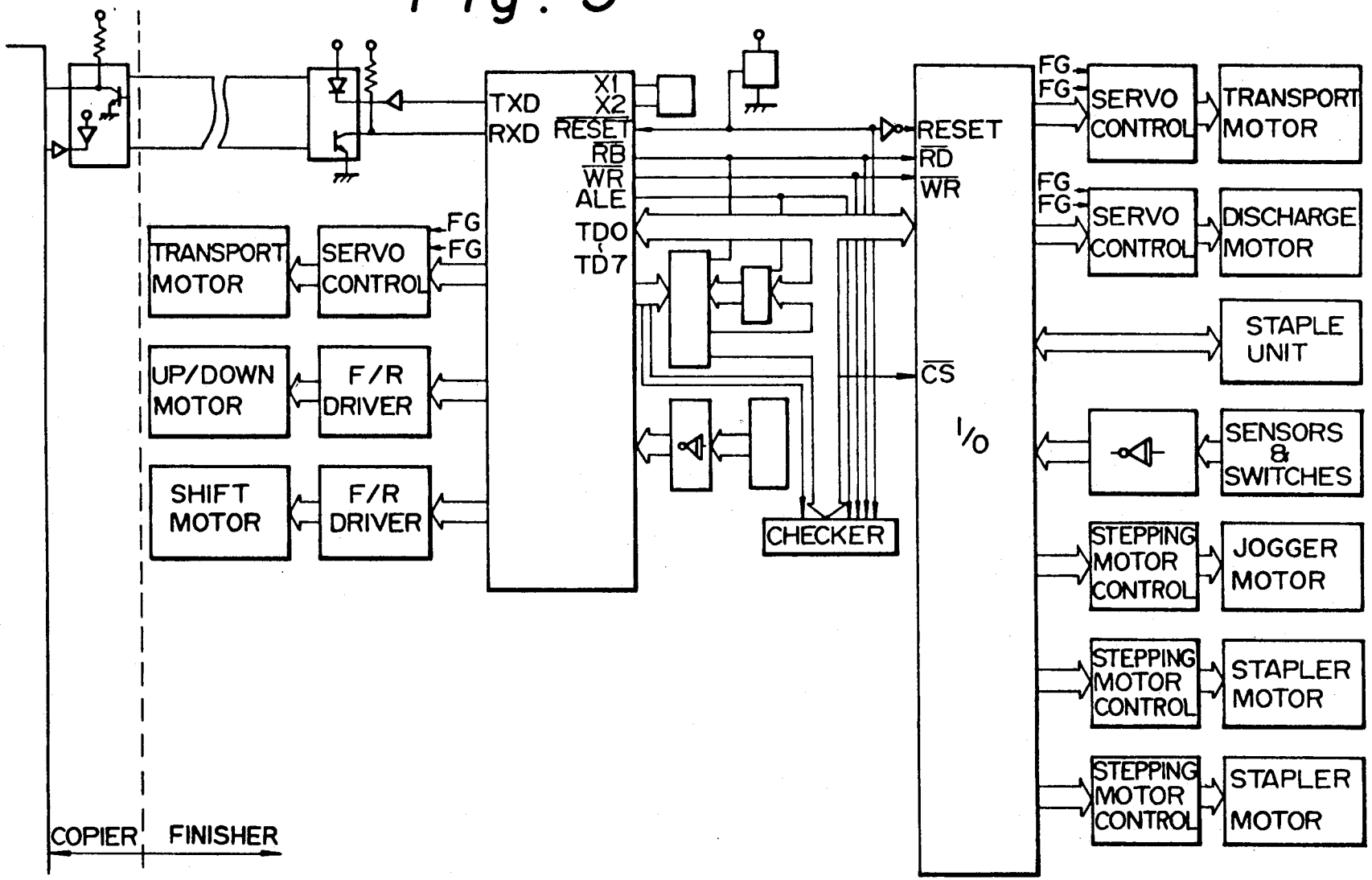
FIG. 5 is a block diagram schematically showing control circuitry for controlling the finisher.

A reference will be made to FIGS. 5, 6, 7A and 7B for describing chiefly the operation of the stepping motor 4 included in the stapler moving device 3. FIG. 5 schematically shows control circuitry for controlling the entire finisher.

In the illustrative embodiment, the stepping motor 4 is implemented as a 4-phase stepping motor which is energized on a 2-phase basis. As shown in FIGS. 7A and 7B specifically, a different energization pattern is assigned to each of the rightward and leftward movements. Assume that two stepping motors 4 each rotates at a speed of 500 PPS (meaning that the energization changes every 2 milliseconds), and that the displacement per sheet set 2 is 11 millimeters (length of one staple 1) plus 0.5 millimeter. Then, when the stapler 10 moves 0.064 millimeter per step, the displacement is $11.5 \div 0.064 = 179.7$, i.e., nearly 180 in terms of the number of steps.

Let the phases $A_0$, $B_0$, $A_1$ and $B_1$ of each stepping motor 4 be represented by bits 0, 1, 2 and 3, respectively. Then, in the case of leftward movement, the energization pattern sequentially and cyclically changes in the order of 9, 3, 6, 12 and 9. Likewise, in the event of rightward movement, the energization pattern cyclically changes in the order of 12, 6, 3, 9 and 12. Such energization patterns are successful in controlling the movement of two stepping motors 4.

Figure 8A:
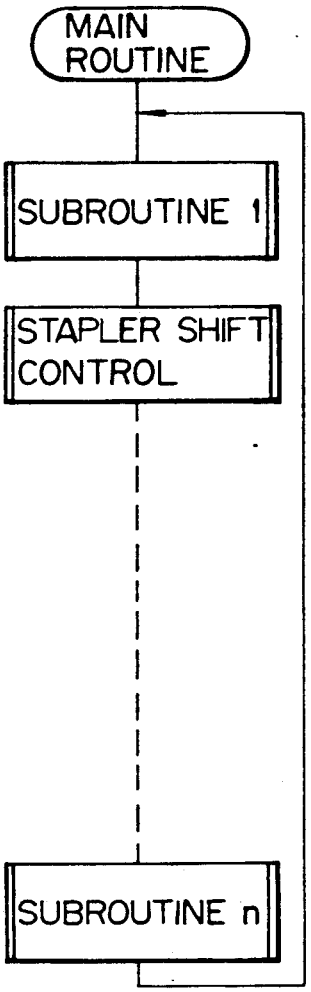
FIGS. 8A, 8B and 9 are flowcharts demonstrating a specific operation of the embodiment.
Figure 8B:
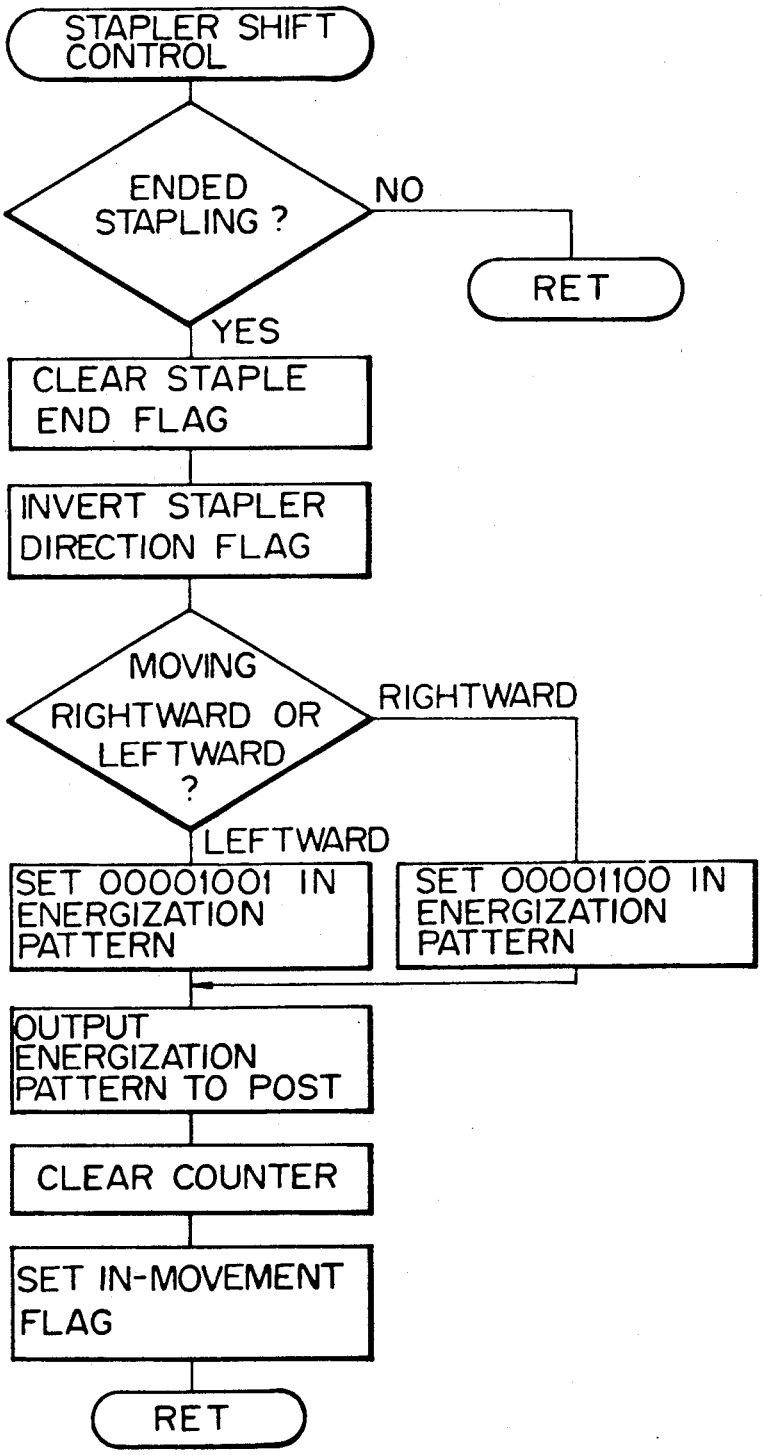
Figure 9:
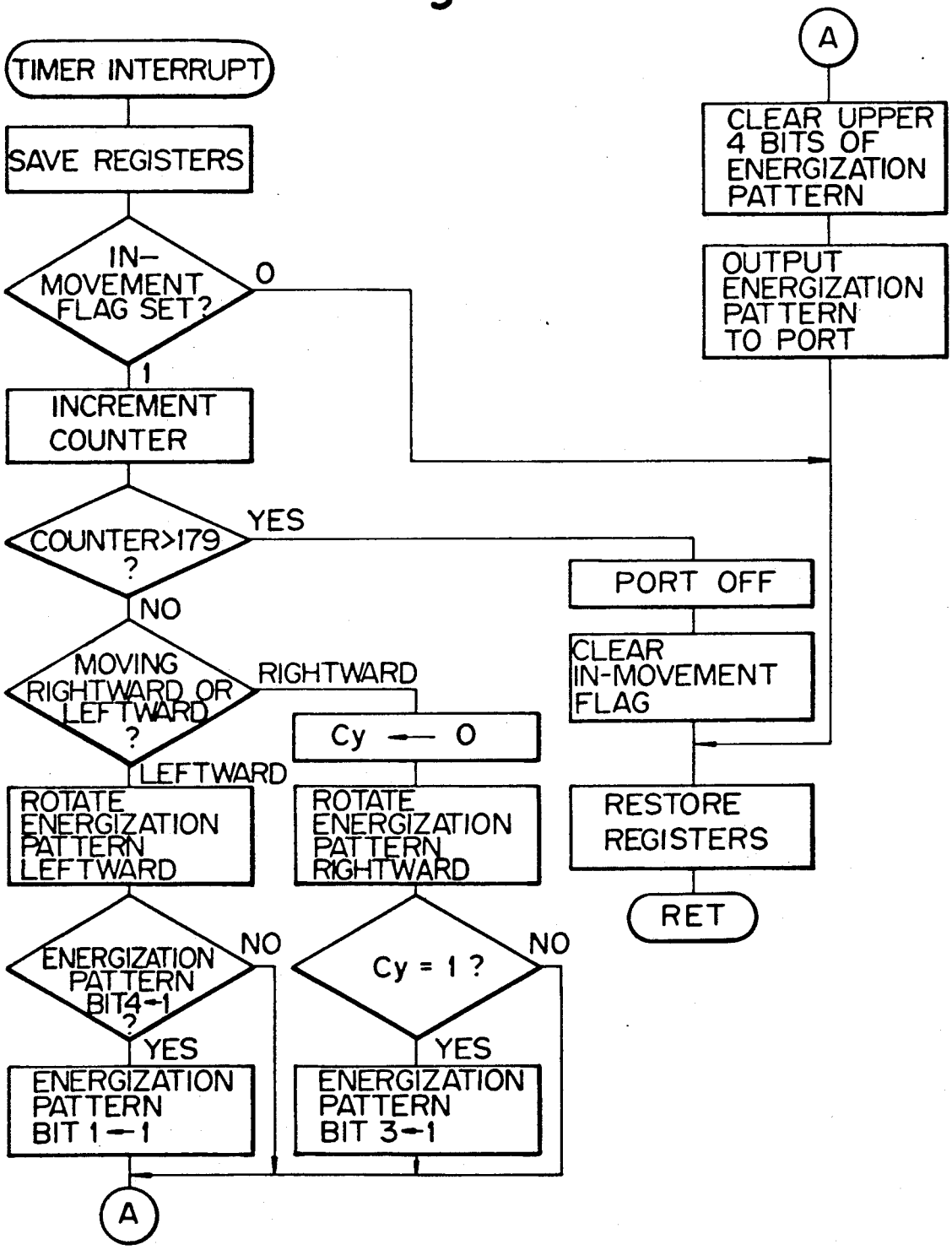

Referring to FIGS. 8A, 8B and 9, how the movement of the stapler 10 is controlled will be described. Specifically, FIG. 8A shows subroutines for controlling the entire finisher. FIG. 8B shows one of such subroutines which pertains to the control over the movement of the stapler 10. In FIG. 8B, at the end of stapling, a staple end flag is set by another subroutine, not shown. If the staple end flag has already been set, it is cleared and a flag representative of the direction of movement of the stapler 10 is inverted. When the stapler 10 moves to the left, "00001001 (=9)" is set in a register which is named "energization pattern" in the flowcharts. In the event of rightward movement, "00001100 (=12)" is set in the register. The lower four bits of the register are used as an energizing signal. Thereafter, the "energization pattern" is outputted to a port to count the number of steps. Subsequently, a register named "counter" in the flowcharts is cleared, and an in-movement flag showing that the stapler 10 is in movement is set. The movement of the stapler 10 is controlled by the above-described sequence of steps.

Figure 10A:
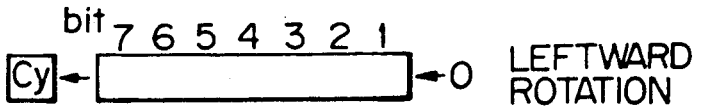
FIGS. 10A and 10B show how the contents of the bits of each register shown in FIG. 9 are shifted.
Figure 10B:
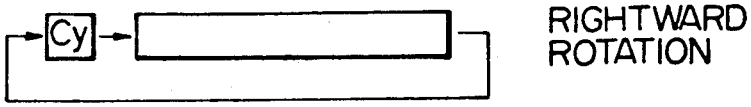

FIG. 9 shows a specific timer interrupt sequence. Since the energizing speed of each stepping motor 4 is 500 PPS, timer interruption is effected every 2 milliseconds to advance the energization pattern. At the beginning of the interrupt sequence, the contents of the registers are saved. Then, the in-movement flag is referenced to see if the stapler 10 is in movement. If the in-movement flag is not set, no processing is executed. If it is set, the "counter" is incremented to count the steps. Whether or not the "counter" has exceeded 179 is determined. If the "counter" has exceeded 179, meaning that the stapler 10 has completed the movement, the energization is interrupted. Then, the in-movement flag is cleared to end the timer interrupt sequence. If the "counter", i.e., the number of steps is less than 179, the direction in which the stapler 10 is moving is determined. If the stapler 10 is moving to the left, the "energization pattern" is rotated to the left. As shown in FIG. 10A, the leftward rotation sequentially shifts the contents of the bits to the left and sets 0 in the bit 0 while setting the bit 7 in Cy (Carry). If the bit 3 is 1 before the leftward rotation, the bit 4 will be 1 after the rotation. In such a case, 1 is set in the bit 0. As a result, the lower four bits of the "energization pattern" sequentially changes in the order of 9, 3, 6, 12 and 9 in response to every interruption and is fed to the port to rotate the stepping motor 4. If the stapler 10 is moving to the right, 0 is set in Cy to rotate the "energization pattern" to the right, as shown in FIG. 10B. At this time, Cy is set in the bit 7, the bit 7 is set in the bit 6, and the bit 0 is shifted to Cy. If the bit 0 is 1 before such a rightward rotation, Cy will be 1 after the rotation. In such a case, 1 is set in the bit 3. Consequently, the lower four bits of the "energization pattern" sequentially changes in the order of 12, 6, 3, 9 and 12 in response to every interruption and is fed to the port to rotate the stepping motor 4 accordingly. The control described above with reference to FIGS. 8A, 8B and 9 allows successive sets of sheets 2 to be surely driven out and neatly stacked on a tray.

In summary, it will be seen that the present invention provides a finisher for an image recorder in which a staple position changing device controls a stapler moving device to staple a set of sheets at a position which is shifted by at least more than the length of a staple from the position where the preceding set of sheets was stapled. The resultant sets each being stapled at a different position can be stacked in a desirable manner and can be driven out far more desirably than in the case of a conventional finisher.

Various modifications will become possible for those skilled in the art after receiving the teachings of the present disclosure without departing from the scope thereof.

What is claimed is:

1. A finisher for binding each predetermined number of sheets sequentially fed to said finisher by a stapler having staples and thereby producing a plurality of stapled sets of sheets, comprising:

stapler moving means for moving said stapler means in a lengthwise direction of said staples;

staple position control means for controlling said stapler moving means such that said stapler moving means shifts said stapler means by a predetermined amount with each of the sets of sheets and thereby causes said stapler means to staple a given set of sheets at a particular position different from a position where the preceding set of sheets was stapled;

wherein said staple position control means causes said stapler moving means to shift a staple position for each stapled set of sheets such that a first sheet set and a second sheet set are stapled at different positions and said second sheet set and a third sheet set are stapled at different positions, wherein individual sheets of said first sheet set are all of equal size to each other and to individual sheets of said second sheet set and said third sheet set.

2. A finisher as claimed in claim 1, further comprising transporting means for transporting each of the sets of sheets stapled at different positions to a tray.

3. A finisher as claimed in claim 2, wherein said tray is lowered in matching relation to the amount of sets of sheets stacked on said tray, such that the top of a stack on said tray remains at a constant level.

4. A finisher as claimed in claim 1, wherein said stapler means comprises a single stapler, said stapler moving means comprising a single stepping motor.

5. A finisher as claimed in claim 1, wherein said stapler means comprises a plurality of staplers, said stapler moving means comprising a plurality of stepping motors.

6. A finisher as claimed in claim 4, wherein said stepping motor is energized in specific patterns to move said stapler moving means in a predetermined pattern controlled by subroutines of said staple position control means.

7. A finisher as claimed in claim 6, wherein said stepping motor is implemented as a 4-phase stepping motor which is energized on a 2-phase basis.

8. A finisher as claimed in claim 7, wherein said specific patterns include timer interrupt sequences during movement of said stapler moving means.

9. A finisher as claimed in claim 1, wherein said staple position control means causes said stapler means to staple a set of sheets at a position which is shifted by at least more than the length of a staple from a position where a preceding set of sheets is stapled.

* * * * *